United States Patent [19]

Hansen

[11] 4,251,087

[45] Feb. 17, 1981

[54] TRUCK APPARATUS FOR SKATE AND SKATEBOARD DEVICES

[75] Inventor: H. Gordon Hansen, Sunnyvale, Calif.

[73] Assignee: Royalty Investors, Saratoga, Calif.

[21] Appl. No.: 13,626

[22] Filed: Feb. 21, 1979

[51] Int. Cl.[3] ..... A63C 17/02

[52] U.S. Cl. ..... 280/11.28; 280/87.04 A

[58] Field of Search ..... 280/11.28, 11.27, 11.19, 280/87.04 A, 87.04 R, 11.23, 11.25, 11.26

[56] References Cited

U.S. PATENT DOCUMENTS

| | | | |
|---|---|---|---|
| 616,773 | 12/1898 | Daniels | 280/11.28 |
| 2,466,070 | 4/1949 | Balstad | 280/11.28 |
| 2,552,035 | 5/1951 | Cooke et al. | 280/11.28 |
| 2,595,751 | 5/1952 | Balstad | 280/11.28 |
| 2,763,490 | 9/1956 | Crone | 280/11.28 |
| 2,920,899 | 1/1960 | Crone | 280/11.28 |
| 3,087,739 | 4/1963 | Ware | 280/11.28 |
| 3,442,523 | 5/1969 | Butler | 280/11.28 |
| 3,774,924 | 11/1973 | Machatsch | 280/11.28 |
| 3,870,324 | 3/1975 | Balstad | 280/11.28 |
| 4,047,725 | 9/1977 | Pinchock | 280/11.28 |
| 4,047,727 | 9/1977 | Holladay et al. | 280/11.28 X |
| 4,060,253 | 11/1977 | Oldendorf | 280/11.28 X |
| 4,071,256 | 1/1978 | Kimmell | 280/87.04 A X |
| 4,103,917 | 8/1978 | Widolf | 280/11.28 |
| 4,120,508 | 10/1978 | Brown et al. | 280/11.28 |
| 4,152,001 | 5/1979 | Christianson | 280/11.28 |

*Primary Examiner*—John P. Silverstrim
*Assistant Examiner*—Milton L. Smith
*Attorney, Agent, or Firm*—Claude A. S. Hamrick

[57] ABSTRACT

Truck apparatus for skate and skateboard devices including an elongated kingpin, means for affixing the upper end of the kingpin to the bottom of a load carrying platform at a selected angle and having a member disposed midway along the length of the kingpin and a friction surface and stop means, a wheel axle carriage assembly pivotally affixed to the lower end of the kingpin and adapted to rotate about the axis of the kingpin and having a second friction surface and stop lugs, a resilient drag sleeve and turn restoring element compressively disposed between the first and second friction surfaces, and a lock nut for selectively urging the carriage assembly toward the mid-portioned member so as to compress the drag sleeve between the first and second friction surfaces with a predetermined compression force such that the carriage assembly may be resistively and partially resiliently rotated about the axis of the kingpin within a range determined by the interaction of the stop lugs and the stop means and with a degree of freedom determined by the compression of the drag sleeve.

10 Claims, 9 Drawing Figures

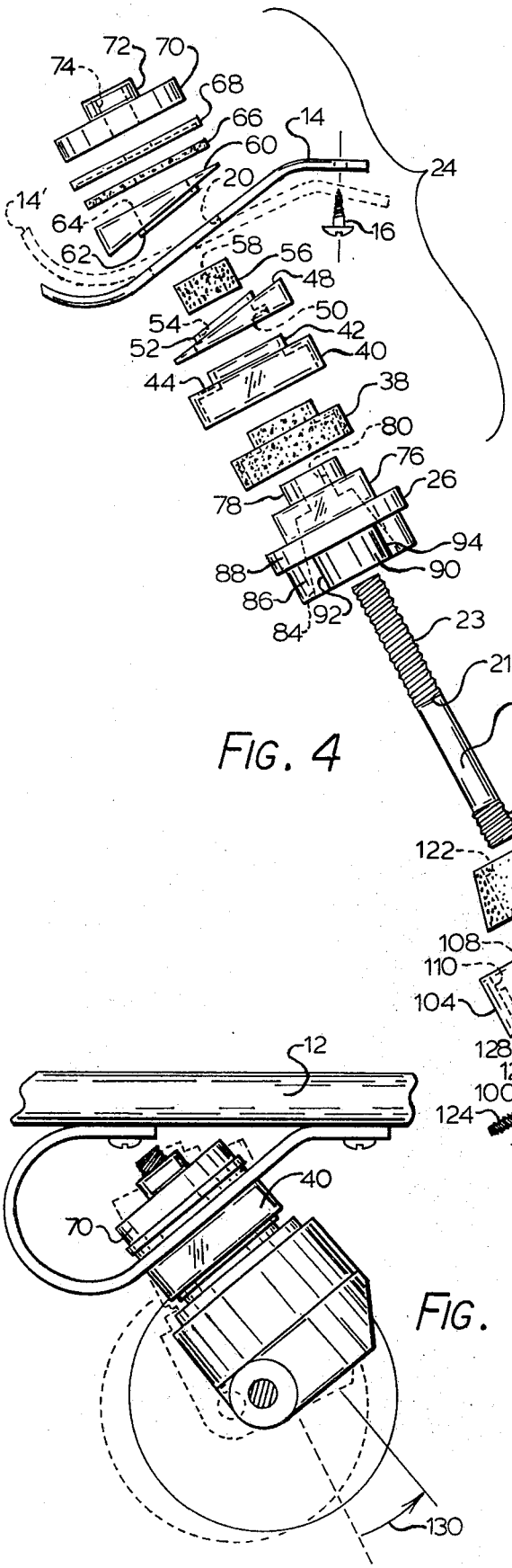
FIG. 4
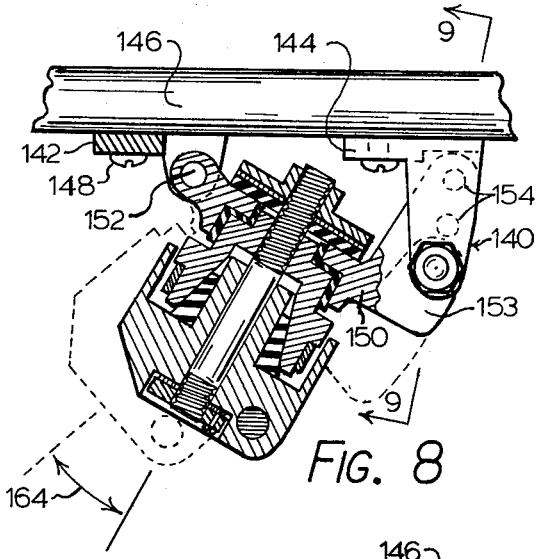
FIG. 8
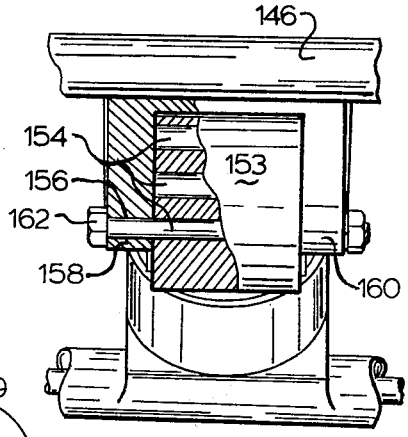
FIG. 9
FIG. 7

TRUCK APPARATUS FOR SKATE AND SKATEBOARD DEVICES

BACKGROUND OF THE INVENTION

1. Field of the Invention

The present invention relates generally to truck apparatus for skate and skateboard devices, and more particularly to a truck assembly having readily adjustable kingpin angle and torque resistive features.

2. Description of the Prior Art

Although the prior art is replete with configurations of skate and skateboard truck mechanisms, all previous designs may generally be categorized into two general classes; i.e., the class in which the truck axle is constrained more or less rigidly to rotate about a fixed kingpin axis with rotation about the kingpin axis being resisted by some type of resilient member that is typically placed in both shear and compression simultaneously, and the class of configurations in which the primary loading to the truck is carried by a heavily bushed stud bolt and the truck turn radius is determined by an arm that extends from the truck axle to pivotally intersect either the bottom of the skate board or a truck-mounting plate. Examples of the former type of truck are illustrated in the following U.S. Pat. Nos: Balstad, 2,466,070 and 2,595,751; Crone, 2,763,490; Crone 2,920,899; Ware, 3,087,739; Butler, 3,442,523, Balstad, 3,870,324; Pinchock 4,047,725; and Kimmell, 4,071,256; while examples of the latter are disclosed in the U.S. patents to Machatsch, U.S. Pat. No. 3,774,924; Holladay et al, U.S. Pat. No. 4,047,727; Oldendorf, U.S. Pat. No. 4,060,253; and Widolf, U.S. Pat. No. 4,103,917.

Basically, the turning of a skate or skateboard is accomplished by a shifting of the rider's weight to an off-center position on the supporting platform so as to cause a torquing movement about the various supports. As a result, the supporting bushings are compressed or torqued such that the resolution of forces about the axes of the various support members causes the truck axles to rotate about more or less determinable axes angularly intersecting the supporting platform and as a result causing each truck wheel set to turn relative to the longitudinal axis of the supporting surface. However, in most cases, the turning action is nonuniform and nonreproducible because different variations of side loading cause different angular orientations of the truck axles, and conversely, different reductions in side loading cause different restoring forces to be applied to the truck axles.

One disadvantage of such prior art structures is that since turns are effected by compressing or otherwise stressing a block of resilient material, the restoring force is more or less proportional to the angle of turn, and as a consequence where the rider attempts to maintain a sharp turn he must continuously exert a substantial force against what is usually a strong restoring force. As a result, any inadvertent shift in weight allows the restoring force to abruptly change the turning angle of the truck, in many cases to the extent that it causes the rider to at least momentarily lose his balance and control. It would be much more desirable if the restoring force was selectable and constant for all angles of turn.

Another disadvantage of the prior art is that with the exception of the angle pad accessory disclosed in the above-mentioned Oldendorf patent, none of the prior art truck assemblies provide means allowing a simple selective adjustment of the kingpin axis angle and thus do not allow a rider to select the turning characteristics most suited to his skill.

Still another disadvantage of the prior art truck configuration is that very high shear and compression loads are placed upon the resilient elements with the result that their useful life is quite limited.

SUMMARY OF THE PRESENT INVENTION

It is therefore a principal object of the present invention to provide an improved truck apparatus which overcomes the above-mentioned disadvantages.

Another object of the present invention is to provide an improved truck apparatus which permits uniform and reproducible turning action.

Another object of the present invention is to provide an improved truck apparatus in which the kingpin axis angle can be easily changed to suit the skill of the rider.

Still another object of the present invention is to provide an improved truck apparatus having direction restoring means that are adjustable over a wide range, yet allow the truck to run at angles independent of the selected restoring force.

Briefly, a presently preferred embodiment of the invention includes an elongated kingpin, means for affixing the upper end of the kingpin to the bottom of a skateboard at a selected angle and including a member disposed midway along the length of the kingpin and having a friction surface and stop means, a wheel axle carriage assembly pivotally affixed to the lower end of the kingpin and adapted to rotate about the axis of the kingpin and having a second friction surface and stop lugs, a resilient drag sleeve and turn restoring element compressively disposed between the first and second friction surfaces, and means for selectively urging the carriage assembly toward the mid-positioned member so as to compress the drag sleeve between the first and second friction surfaces with a predetermined compression force such that the carriage assembly may be resistively and partially resiliently rotated about the axis of the kingpin within a range determined by the interaction of the stop lugs and the stop means and with a degree of freedom determined by the compression of said drag sleeve.

Among the advantages of the present invention over the prior art are that the maximum turning radius of the truck assembly is not limited by the compression or shear strength of an elastomeric member but is instead determined by fixed stops; that the resistance to turn over the turn range is substantially uniform; and that the kingpin angle is predeterminable.

These and other objects and advantages of the present invention will no doubt become apparent to those of ordinary skill in the art after having read the following detailed description of certain embodiments illustrated in the several figures of the drawing.

IN THE DRAWING

FIG. 4 is an exploded side view showing the various component parts of the subject truck apparatus;

FIG. 7 is a side view illustrating a modified embodiment of the truck apparatus disclosed in FIGS. 1-6;

FIG. 8 is a partially broken axial cross section showing an alternative embodiment of a truck apparatus in accordance with the present invention; and FIG. 9 is a partially broken front view taken along the line 9—9 of FIG. 8.

DETAILED DESCRIPTION OF THE PREFERRED EMBODIMENT

Figure 1:
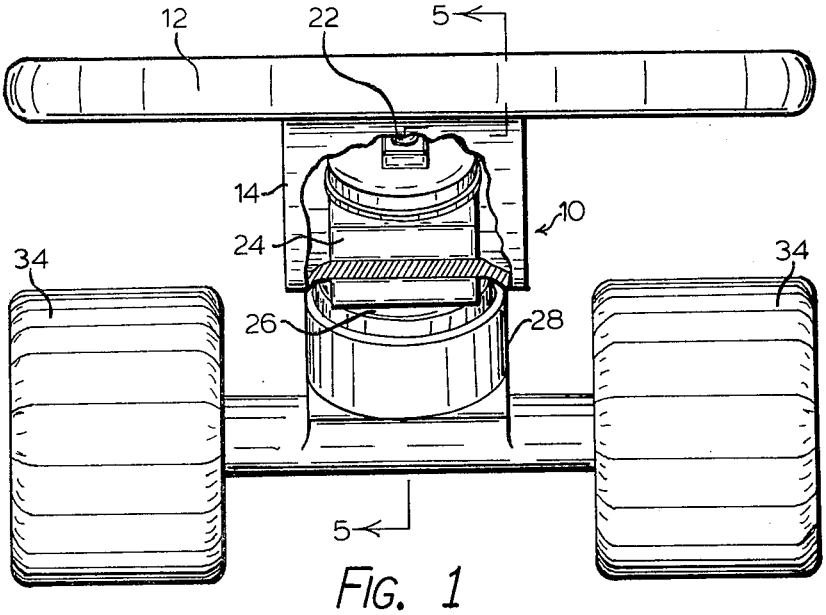
FIG. 1 is a partially broken front view of a skateboard and truck apparatus in accordance with the present invention.
Figure 2:
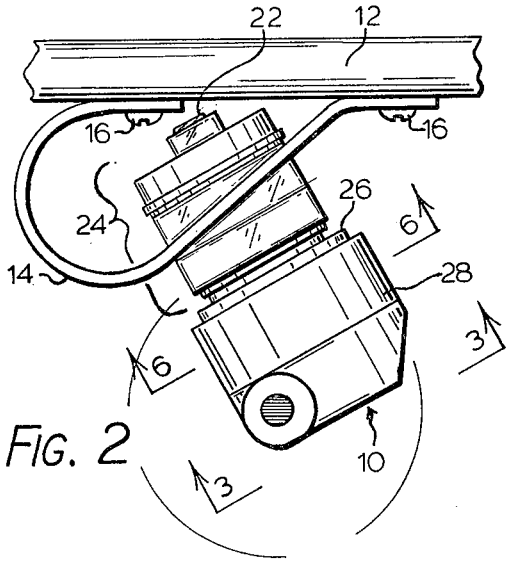
FIG. 2 is a side view of the truck apparatus shown in FIG. 1 with the left side wheel removed.

Referring now to FIGS. 1 and 2 of the drawing, there are shown at 10, front and side views respectively, of a skateboard truck apparatus affixed to the bottom surface of a board 12. As illustrated in these figures, the truck apparatus 10 includes a mounting bracket 14 which is affixed to the bottom of board 12 by four screws or other suitable means 16, two of which are shown in FIG. 2. As is further illustrated in FIG. 3, which is a view taken along the line 3—3 of FIG. 2, bracket 14 has two rear apertures 18, two more front apertures (not shown) for receiving the screws 16, and a rectangular aperture 20 for accommodating the fastening of the truck mechanism thereto.

Figure 3:
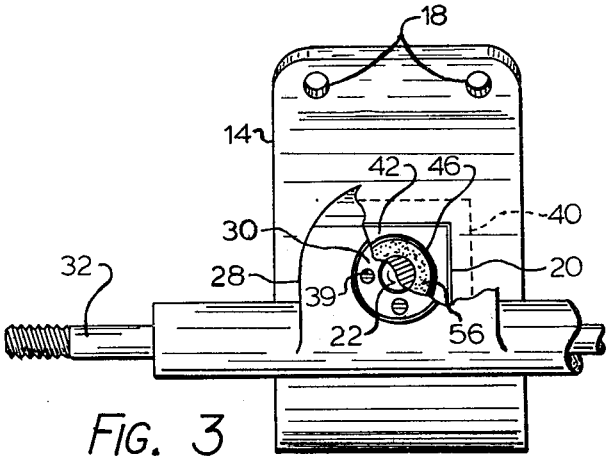
FIG. 3 is a partially broken bottom view of the truck apparatus taken along line 3—3 of FIG. 2.

The truck mechanism per se includes a kingpin 22, the upper end of which is visible in FIGS. 1 and 2, and the lower end of which is visible in FIG. 3, a clamping means, designated generally by the reference numeral 24, for clamping kingpin 22 to bracket 14 at a predetermined angular intersection and which includes a member 26 that is rigidly affixed to kingpin 22, as will be explained in more detail below, and an axle carriage means 28 which is pivotally attached to the lower end of kingpin 22 by means of a lock nut 30 (FIG. 3). Press fit into the carriage 28 is a wheel axle 32, both ends of which are threaded to receive nuts (not shown) for locking the wheels 34 onto the axle.

Figure 5:
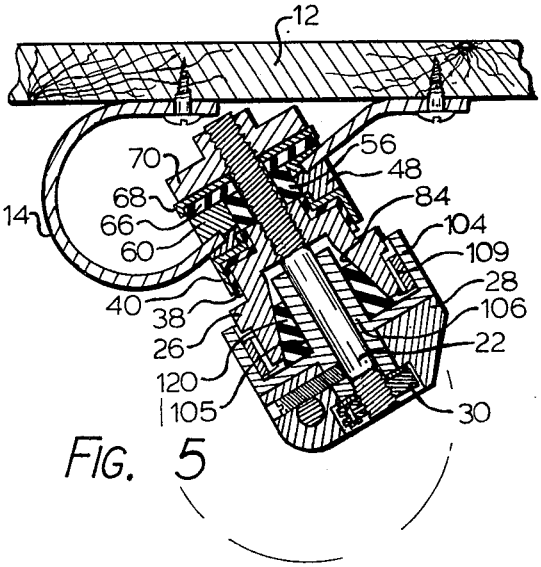
FIG. 5 is a cross section of the assembled truck apparatus taken along the line 5—5 of FIG. 1.

Turning now to FIG. 4 which is an exploded view separately showing the various components of the subject truck mechanism, and to FIG. 5 which is a cross section taken along the line 5—5 of FIG. 1 showing the components of FIG. 4 in their assembled positions, it will be noted that the clamping means 24 is comprised of the upper portion of member 26 and the several illustrated components 38-70. More specifically, the component 38 is an elastomeric shock isolation pad configured to fit over the top of member 26. The element 40 is a rectangular metal cup including a rectangular lower portion with a smaller rectangular portion 42 extending upwardly from its top surface 44, and having a circular aperture 46 provided therein as illustrated at 46 in FIG. 3. Positioned immediately above cup 40 is a kingpin angle-determining wedge 48 having a rectangular outer perimeter, a rectangular recess 50 formed in the bottom thereof for matingly receiving the upstanding portion 42 of cup 40, and an upstanding rectangular section 52 formed in the top portion thereof with a circular aperture 54 extending therethrough and communicating with the rectangular recess 50.

Shown above wedge 48 is an annular bushing 56 having a cylindrical opening 58 for receiving the kingpin 22. As indicated more clearly in FIG. 5, the lower portion of bushing 56 is intended to nest within the circular opening 54 of wedge 48, while the rectangular upper portion 52 of wedge 58 is intended to mate with the rectangular opening 20 in bracket 14. A second rectangular wedge member 60, similar to wedge 48, is shown above bracket 14. This wedge does not, however, have the rectangular aperture and its base is positioned above bracket 14 so that its downwardly extending rectangular projection 62 mates with bracket opening 20 and engages the top surface of portion 52 of wedge 48. The upper portion of bushing 56 extends upwardly through the cylindrical opening 64 in member 60.

Disposed above wedge 60 is a resilient vibration isolating disc 66, a metal cap washer 68 and a locking nut 70. Nut 70 has a circular lower portion, a rectangular upper portion 72 which may be engaged by a suitable locking tool, and a tapped bore 74 for threadably engaging the threaded upper end 23 of kingpin 22. The upper portion of member 26 has a part 76 that is rectangular in configuration and another part 78 that is of cylindrical configuration and extends upwardly from the top surface of 76. A tapped bore 80 extends through the upper portion of member 26 and communicates with the frusto-conical opening in the lower portion thereof.

When assembled, member 26 is threaded onto the threads 23 of kingpin 22 until it locks against the shoulder 21. The resilient isolating cap 38 is then placed over portions 76 and 78, cup 40 is placed thereover, wedge 48 is mated with the top of cup 40, and bushing 56 is slipped over kingpin 22 so as to extend downwardly through the assembled components until it bears against the top of cylindrical portion 78. The upper end of the subassembly is then inserted through opening 20 in bracket 14 and wedge 60 is placed over bushing 56 with its portion 62 extending into opening 20. Disc 66 and washer 68 are then placed over the end of kingpin 22 and nut 70 is tightened onto threads 23, thereby causing the assemblage to affix the upper end of kingpin 22 to bracket 14. Note that although firmly affixed to bracket 14, the disc 66, bushing 56 and member 38 combine to provide a predetermined amount of shock isolation between the bracket 14 and the assemblage of component parts.

As previously mentioned, the lower portion of member 26 is provided with a frusto-conical cavity having a smooth interior surface 84, while the exterior portion 86 is cylindrical in configuration and the portion immediately thereabove forms a flange 88. Either affixed to the outer surface 86 or formed integral therewith are two arcuate segments 90 that are positioned on opposite sides of member 26 such that the edges 92 and 94 of each segment form stops which will be further described below.

Although carriage 28 may be formed as a single integral unit, in the illustrated embodiment it is comprised of a lower portion 100 having a pair of cylindrical segments 102 projecting laterally therefrom and bored to receive the wheel axle 32, and an upper portion 104 having an integrally formed cylindrical mid-section 106 which is bored axially to receive kingpin 22. An annular recess 110 is formed in the upper portion of 104. The lower portion 100 has a bore 112 of a diameter suitable for matingly receiving portion 106 of member 104 and a larger bore 114 which forms a shoulder 116 at its intersection with bore 112.

As indicated at 109 a pair of arcuate lugs are either affixed to or are formed within the recess 110. These lugs are positioned with their centers diametrically opposite each other on the interior surface of recess 110, and the ends thereof are intended to engage the stops 32 and 94 respectively of member 26 as will be explained below.

Shown positioned above member 104 is a resilient drag sleeve and restoring member 120 which is an elastomeric unit of frusto-conical configuration and has an axial bore 122 formed therein for receiving the upper end of the cylindrical portion 106 of member 104.

In assembling the carriage 28, member 104 is mated to member 100 by inserting portion 106 into the bore 112 and the two are locked together by means of a set screw 124 which is threaded into a tapped bore 126 and extends into a registering bore 128 in member 106. Sleeve 120 is then positioned over the upper end of member 106, and the unit is mated with the lower end of kingpin 22 and is affixed thereto by threading the lock nut 30 onto the threads 25 at the end of kingpin 22. A washer 31 separates nut 30 from shoulder 116 and allows the unit 28 to freely turn on kingpin 22.

Nut 30 is an annular device with a tapped opening 33 passing through its center. It is transversely split as indicated at 35, and after being threaded onto kingpin 22 a screw 37 is used to draw the split portions together to lock nut 30 in position on the threads 25. To facilitate the turning of nut 30, a pair of socket dimples, one of which is shown at 39 in FIG. 3, are provided in the exterior surface thereof so as to permit engagement by a suitable spanning tool.

Note that as indicated in FIG. 5 when the unit is assembled, the upper portion 106 of member 104 carries sleeve 120 into the frusto-conical cavity 84 of member 26 and the tightening of nut 30 causes the sleeve to be placed in compression between the friction surfaces 84 and 105. As a result, sleeve 120 tends to resiliently resist turning action until friction forces determined by the selected compression are overcome and the carriage turns against the frictional drag. Although there will always exist an element of resilient restoring force, its magnitude can be predetermined, and it will usually not completely restore the truck to its straight ahead position.

Figure 6:
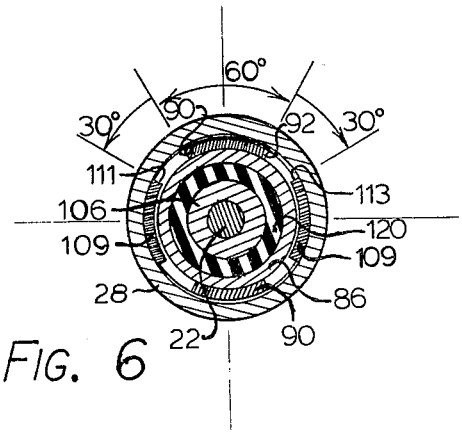
FIG. 6 is a transverse cross section taken along the line 6—6 of FIG. 2.

Turning now to FIG. 6 which is a transverse cross section taken along the line 6—6 of FIG. 2, it will be noted that in the preferred embodiment arcuate segments 90 and 109 are of a length equivalent to 60° of the circumference of member 26, and that their centers are positioned 90° relative to each other. The carriage assembly 28 may therefore be turned 30° in each direction, or a total of 60° before the edges 111 and 113 strike the stops 90 and 92, respectively.

It will thus be appreciated that in accordance with the present invention two adjustments may be made which affect operation of the truck apparatus. The first is that by selecting wedges 48 and 60 of a particular angle, a desired kingpin angle can be selected. The second adjustment is that the choice of restoring force and drag resistance to turn of the carriage assembly is determined by the number of selected turns of nut 30. It will, of course, also be appreciated that replacing the arcuate segments 109 with either shorter or longer segments will either increase or decrease the maximum steering angle of the truck. The latter, however, is not normally changed once a particular setting is selected whereas the two former adjustments may frequently be made to accommodate the particular use or user of the board.

In FIG. 7 a side view of the assembly illustrated in FIG. 2 is depicted with the exception that the wedges 48 and 60, and the bushing 56 have been eliminated to effect a resultant change in the kingpin angle as indicated by the arc 130. The net effect of eliminating these elements is also illustrated by the dashed lines 14' of FIG. 4. As is well known in the prior art, this change of angle will materially affect the radius of turn of the truck per angle of inclination of the board 12.

Turning now to FIGS. 8 and 9 of the drawing, an alternative embodiment of the present invention is illustrated wherein instead of using the wedges 48 and 60 to determine the relative angle between the kingpin 22 and bracket 14, and thus the angle between the kingpin 20 and the board 12, a pivoted bracket assembly 140 is utilized. As indicated, the assembly 140 includes a pair of bases 142 and 144 which are attached to the board 146 in spaced-apart relationship by means of screws 148, and a generally L-shaped carrier member 150 is pivotally attached to the base 142 by a pivot pin 152 while the short leg 153 of the L is provided with three adjustment bores 154, one of which may be aligned with the bore 156 in a pair of downwardly depending arms 158 and 160 of base 144. A bolt 162 is then passed through the aligned openings to complete the adjustment operation. By way of example, note that with the bracket in the position indicated by the solid lines, one extreme of kingpin angle is achieved, while in moving it to the position shown by the dashed lines, a broad angle of adjustment indicated by the arrow 164 is permitted.

From the above description it will be noted that with the truck centered for straight ahead motion, a tilt of the board in either direction will result in a two-phase turning operation. The first phase occurs during that degree of board tilt which is less than the amount required to overcome the frictional resistance between the drag sleeve and the two surfaces upon which it bears, and the second occurs after the drag friction is overcome and until the board is caused to tilt sufficiently to drive the lugs 109 against the stops 90, thereby effecting the maximum angle turn. Note that if during the first phase the tilting force is relieved, the drag sleeve will effect a correcting action due to its resilient character and the board will return to a straight ahead relationship.

However, if the tilt exceeds the friction limit of the drag sleeve, and the rider should momentarily or permanently depart from the board, only limited restoring action will occur and the board will continue to follow substantially the same path of curvature it was taking at the time of departure. This is desirable in that it allows a trick rider to perform a sharp turn, depart sideways and remount the board as it circles about him. Such performance cannot be duplicated with any prior art truck configuration since all prior art trucks return to the neutral position as soon as the board is unloaded.

The inherent boomeranging operation of trucks made in accordance with the present invention is also a safety feature in that should a rider fall during a sharp turn, the board will be less apt to rocket ahead and strike another rider, since the wheels will remain sharply turned and as a result the board will circle and quickly be slowed by the centrifugal forces set up by its own mass.

Although the present invention has been described above in terms of several preferred configurations, it is contemplated that after having read this disclosure numerous alterations and modifications will become apparent to those skilled in the art. It is therefore intended that the instant disclosure be considered as by way of example and not limitation, and that the appended claims be interpreted as covering all such alterations and modifications as fall within the true spirit and scope of the invention.

What is claimed is:

1. Truck apparatus for skate and skateboard apparatus comprising:

an elongated kingpin means;

means for affixing one end of said kingpin means to the bottom of a load-carrying platform at a selected angle and including a member disposed midway along the length of said kingpin and having means forming a first friction surface and stop means;

wheel axle carriage means pivotally affixed to the other end of said kingpin means and adapted to rotate about the axis of said kingpin means, said carriage means having means forming a second friction surface and lug means adapted to engage said stop means when said carriage means is rotated a predetermined angle in either direction about said axis;

resilient drag sleeve and turn restoring means disposed between and in frictional engagement with said first and second friction surfaces; and means for urging said carriage means toward said member so as to compress said resilient means between said first and second surfaces with a selected compression force such that said carriage means may be resistively and partially resiliently rotated about said axis within an angular range determined by the interaction of said stop means and said lug means and with a degree of freedom to turn determined by the compression of said resilient means.

2. Truck apparatus for skate and skateboard apparatus as recited in claim 1 wherein said means for affixing includes a bracket for attachment to the bottom of said load-carrying platform and having a portion angularly oriented relative to the platform bottom, said portion having an aperture therein through which said kingpin means extends.

3. Truck apparatus for skate and skateboard apparatus as recited in claim 2 wherein said member is rigidly secured to said kingpin means and said means for affixing further includes means for threadably engaging said one end of said kingpin means and for clamping said bracket against said member.

4. Truck apparatus for skate and skateboard apparatus as recited in claim 3 wherein said aperture is of a particular noncircular configuration and the facing side of said member is of similar configuration so that a locking engagement may be effected therebetween to prevent said kingpin means from turning relative to said bracket.

5. Truck apparatus for skate and skateboard apparatus as recited in claims 2, 3, or 4 wherein said means for affixing includes wedge shaped means disposed between said bracket and said member so as to determine the angle of orientation between said kingpin means and said bracket.

6. Truck apparatus for skate and skateboard apparatus as recited in claim 5 wherein said means for affixing includes resilient means providing shock isolation between said kingpin means and bracket.

7. Truck apparatus for skate and skateboard apparatus as recited in claims 1, 2, 3 or 4 wherein said first surface is frusto-conical in configuration and forms a cavity in the side of said member facing said carriage means for receiving said resilient means.

8. Truck apparatus for skate and skateboard apparatus as recited in claim 7 wherein said carriage means has an annular cavity formed in the side thereof facing said member for receiving a portion of said member, and wherein said stop means extend outwardly from said portion of said member and said lug means are formed within said annular cavity in position to interferringly engage said stop means when said carriage means is rotated to the limits of said range.

9. Truck apparatus for skate and skateboard apparatus as recited in claims 2, 3, or 4 wherein said bracket includes base means for rigid attachment to the bottom of said load-carrying platform and means for pivotably attaching one side of said bracket portion to said base means and for locking said bracket portion in a selected angular disposition relative to said base means.

10. Truck apparatus for skate and skateboard apparatus as recited in claims 1, 2, 3 or 4 wherein said means for urging includes a lock nut means for slidably engaging said carriage means and for threadably engaging said other end of said kingpin means.

* * * * *